United States Patent [19]

Penick

[11] 4,370,695

[45] Jan. 25, 1983

[54] APPARATUS FOR PREVENTING ELECTROSTATIC CHARGE BUILD-UP ON CRT MONITORS

[75] Inventor: Loren C. Penick, Naperville, Ill.

[73] Assignee: Western Electric Company, Inc., New York, N.Y.

[21] Appl. No.: 201,645

[22] Filed: Oct. 28, 1980

[51] Int. Cl.[3] ..... H05F 3/06

[52] U.S. Cl. ..... 361/213; 361/231

[58] Field of Search ..... 361/213, 231, 212, 214, 361/230

[56] References Cited

U.S. PATENT DOCUMENTS

| | | | |
|---|---|---|---|
| Re. 27,566 | 1/1973 | Simons . | |
| 1,914,110 | 6/1933 | Chapman . | |
| 3,318,076 | 5/1967 | Baker . | |
| 4,188,530 | 2/1980 | Miller | 361/213 |
| 4,213,167 | 7/1980 | Cumming et al. | 361/213 |
| 4,319,302 | 3/1982 | Moulden | 361/213 |

OTHER PUBLICATIONS

H. L. Rowe, "Prevention of Static Discharge in Display Tubes" IBM Tech. Discl. Bull., vol. 20, No. 12, May 1978, p. 5353.

W. C. Bartholomay, "Method of Saving Integrated Circuits," RCA Tech. Notes, TN No. 1214, Sep., 1978.

*Primary Examiner*—G. Z. Rubinson
*Assistant Examiner*—L. C. Schroeder
*Attorney, Agent, or Firm*—K. R. Bergum

[57] ABSTRACT

Several CRT monitor assemblies, (10, 10', 10'', 40, 60, 120, 170, 190), each of which incorporates a specially constructed de-ionized air generating system (12, 12', 12'', 45, 70, 130, 175, 175') are adapted to produce a laminar-type flow of de-ionized air, in a predetermined direction, across the screen (**26, 26', 26'', 42*a*, 66*a*–69*a*, 126*a*–129*a*, 171*a*, 172*a*, 171*a'*, 172*a'*) of one or more monitors (11, 42, 66–69, 126–129, 171, 172**) so as to prevent the build-up of detrimental static charge on the screens. In one particular application, wherein monitors of the computer-controlled graphics display type are employed as visual aids in circuit pack assembly and testing operations, it has been found that the excessively high values of static charge that normally tend to build-up on each monitor screen can often seriously impair, if not destroy, the operating function of many types of IC devices, particularly those of the mos-type, should they be brought into the field of such a static charge during routine handling at an assembly or test station. Advantageously, neither the de-ionized air generating system, nor the confined flow of de-ionized air produced thereby, in any way interferes with the comfort or the work functions required of an operator while utilizing such a monitor.

When multiple CRT monitors are required in a given manufacturing operation of the type in question, they may advantageously be arranged in specially configured clusters, and within a common auxiliary housing (65, 122), so as to substantially reduce the floor space required, and further significantly facilitate the simplification, and reduce the cost, of the composite de-ionized air generating system employed in conjunction therewith.

43 Claims, 12 Drawing Figures

FIG. 10
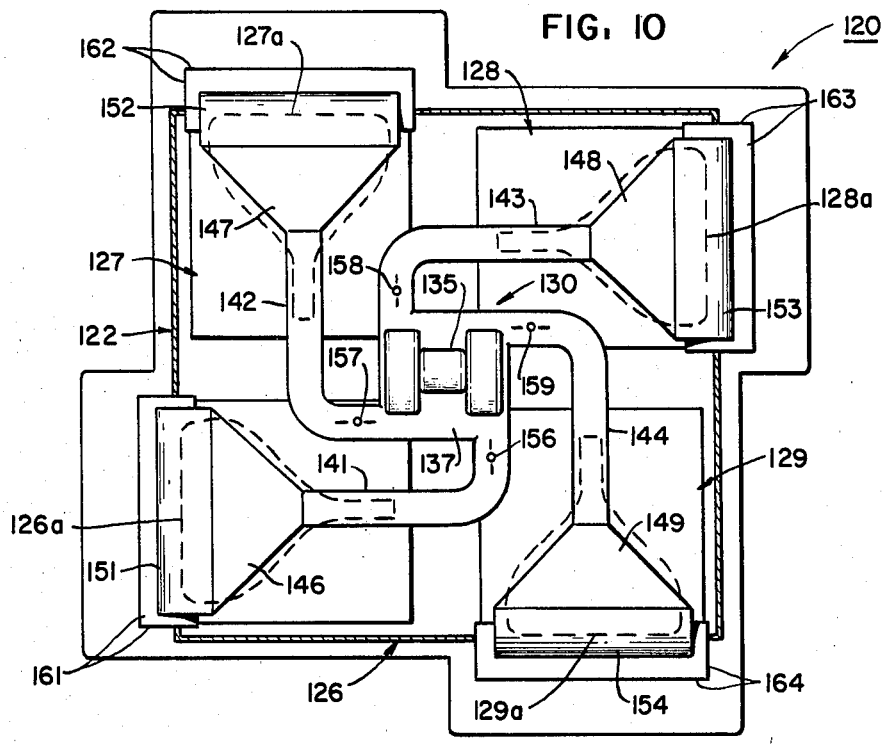
FIG. 11
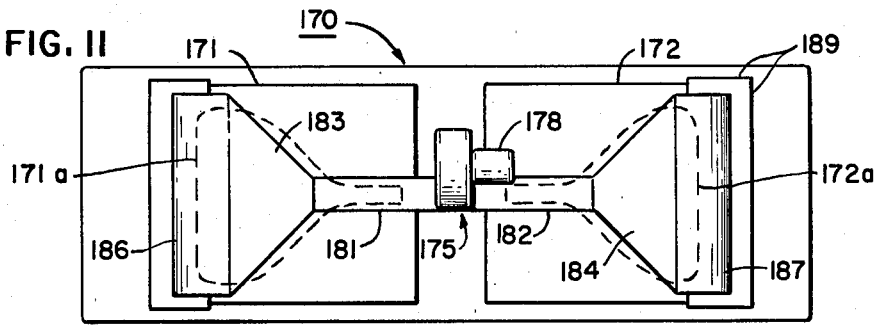
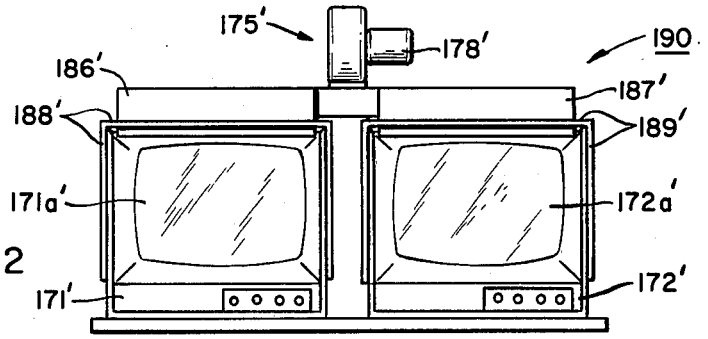
FIG. 12

APPARATUS FOR PREVENTING ELECTROSTATIC CHARGE BUILD-UP ON CRT MONITORS

TECHNICAL FIELD OF THE INVENTION

This invention relates to CRT monitors and, more particularly, to preventing electrostatic charge build-up on the display screens thereof.

BACKGROUND OF THE INVENTION

In using a computer-controlled CRT monitor (preferably of the graphics display type) as a visual aid in circuit pack assembly and/or testing operations, for example, excessively high values of electrostatic charge normally tend to build up on the cathode ray tube (CRT) screen (or face plate) of such a monitor. Such an electrostatic charge can often seriously impair, if not destroy, the operating functions of many types of IC devices, particularly those of the mos-type, should they be brought into the field of such charge during routine handling at an assembly or test station.

When monitors of the above type have been employed in high volume applications heretofore, they have also typically been arranged in multiple rows, and independently housed. Such an arrangement not only requires considerable costly factory floor space, but has not been conducive to the utilization of any common means associated with the monitors for overcoming the troublesome problem of electrostatic charge build-up on the screens thereof.

SUMMARY OF THE INVENTION

It, therefore, is an object of the present invention to prevent the build-up of electrostatic charge on the screen of one or more CRT monitors in a simplified, inexpensive and reliable manner and, in so doing, in no way interfering with the necessary work functions, or comfort, of an operator.

In accordance with the principles of the present invention, the above and other objects are realized in one preferred embodiment through the use of a de-ionizing air generating system which is applicable for use with any type of CRT monitor. The generating system includes an ionized air blower, a fan-out nozzle, a forming nozzle and shields to provide and direct a continuous, low velocity, laminar-type stream of de-ionizing air across the entire outer surface of the CRT monitor screen, from the top to the bottom thereof in accordance with several preferred illustrative embodiments. Considered more specifically, the initially ionized air produced (or generated) by the blower, upon being channeled into a laminar-type air stream, and then directed across an energized CRT monitor screen (or face plate), actually becomes what is referred to hereinafter as a de-ionizing air stream. The rate at which such a de-ionizing stream becomes de-ionized is accelerated in accordance with the principles of the present invention (because of progressively becoming more neutralized) when directed across, and subjected to an electrostatic charge tending to otherwise build-up on, the screen of an energized monitor.

Significantly, it is such a controlled and confined de-ionizing air flow that advantageously has been found to prevent any build-up of detrimental electrostatic charge on the monitor screen. In addition, neither the de-ionizing air generating system nor the confined flow of de-ionizing air produced thereby, in any way interferes with the work functions required of any operator.

In accordance with other embodiments of the invention, a common de-ionizing air generating system may be employed with two or more CRT monitors, and may be secured either to the cabinet of each monitor, or to an auxiliary housing employed to enclose both the generating system and whatever number of monitors are employed therewith. In two preferred multi-monitor assembly embodiments, for example, four CRT monitors are uniquely clustered to conserve space in diametrically disposed, offset pairs within a common quadrangular housing, together with a de-ionizing air generating system that is secured to only the housing. Such an arrangement advantageously allows the use of either a single, common de-ionized air blower, or a pair of such blowers, each associated with a different pair of monitors, to direct a uniformly distributed flow of such air to all four monitors in a simplified and inexpensive manner. With the de-ionizing air generating system being secured to only the housing, any of the monitors may be readily removed therefrom for repair or replacement. Additional embodiments of the invention disclose how a common de-ionizing air generating system may be employed with any number of CRT monitors, whether arranged in a predetermined cluster, or in a row.

BRIEF DESCRIPTION OF THE DRAWINGS

FIG. 10 is a plan view of a CRT monitor assembly similar to that of FIGS. 7–9, but distinguishing therefrom by utilizing a single de-ionized air blower common to all four CRT monitors;

FIG. 11 is a schematic plan view of a CRT monitor assembly wherein two monitors are arranged in a back-to-back relationship, with a common de-ionizing air generating system, and FIG. 12 is a schematic plan view of a CRT monitor assembly wherein two (or optionally more) monitors are arranged in juxtaposed relationship, with a common de-ionizing air generating system.

DETAILED DESCRIPTION OF THE INVENTION

It should be appreciated that while the invention is described in detail herein primarily in regard to preventing electrostatic charge build-up on CRT monitors employed in connection with the assembly and/or testing of circuit packs, or boards, utilizing IC devices, the elimination of such electrostatic charges may be of equal importance and significance in diverse other applications and environments.

As previously noted, it has been found that the operating functions of many types of IC devices, particularly those of the aforementioned mos-type, can be seriously impaired, if not destroyed, should they be brought into the field of a CRT-generated electrostatic charge, often exhibiting voltage levels on the order of 4,000 to 5,000 volts, albeit with extremely low levels of current.

Figure 1:
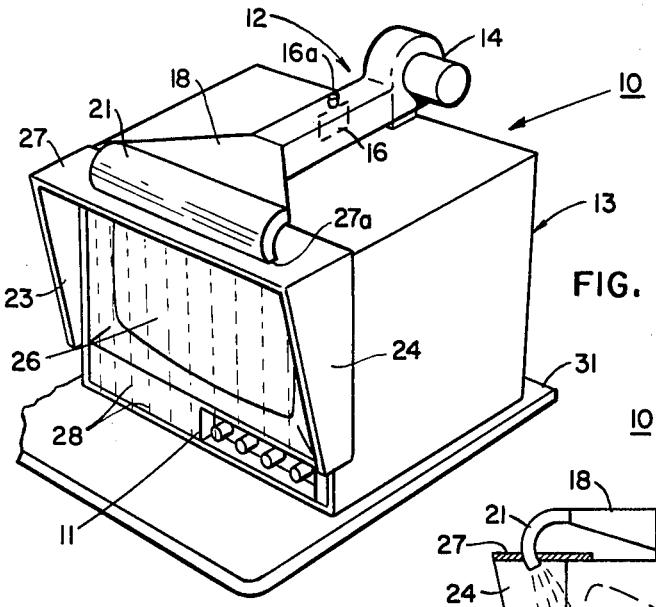
FIG. 1 is a perspective view of a CRT monitor assembly, including a cabinet-confined monitor, and a de-ionizing air generating system mounted on the cabinet, the latter being adapted to provide and direct a confined, laminar-type stream of de-ionizing air across the monitor screen so as to prevent detrimental electrostatic charge build-up thereon in accordance with the principles of the present invention.
Figure 2:
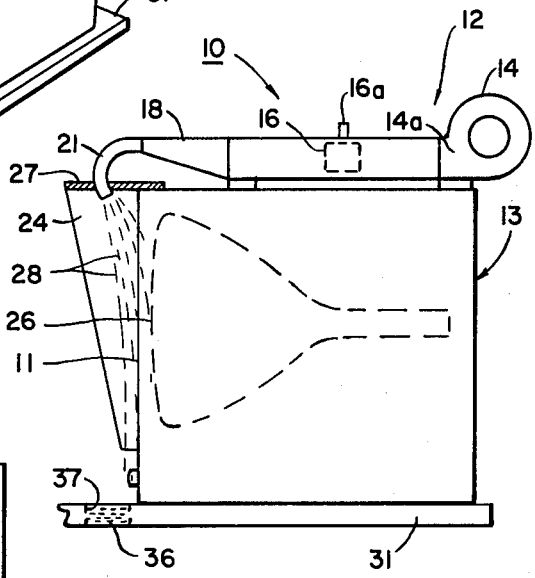
FIG. 2 is a side elevational view of the CRT monitor assembly of FIG. 1, with the cathode ray tube of the monitor shown in phantom.

With particular reference now to the first of several preferred embodiments of the invention, FIGS. 1 and 2 depict a CRT monitor assembly 10 that includes a video display monitor 11 and a de-ionizing air generating system 12, the latter being mounted on the top surface of a conventional cabinet 13 that normally forms part of the monitor. An optional auxiliary housing for such a composite assembly will be described hereinbelow in connection with a related embodiment of the invention depicted in FIGS. 3 and 4.

The monitor 11 in FIG. 1, as well as in all of the embodiments, may be of a conventional type utilizing either black and white or color display circuitry, with the appropriate cathode ray tube. The monitor may also have computer-controlled display capability, as desired for the particular application of concern herein.

In accordance with the principles of the present invention, the de-ionizing air generating system 12 includes an ionized air blower 14, with an output port **14*a* (see FIG. 2) coupled to an associated duct 16 which, in turn, is coupled to a wedge-shaped fan-out nozzle 18. The latter communicates with an arcuate air stream-forming nozzle 21, and two monitor side shields 23 and 24. It should be understood, of course, that while the duct 16, fan-out nozzle 18 and forming nozzle 21** are described as being formed of separate, but interconnected parts, they could also be readily fabricated initially during manufacture as a composite one or two-piece unit. One preferred type of de-ionized air blower found to be very effective for the purpose in question is sold by the 3M Company, as Model No. 905, and is adapted to function as either a single or dual output port type.

With respect to the forming nozzle 21, it is dimensioned and positioned not only to extend laterally across the upper forward edge of the monitor cabinet 13, but is suitably contoured so as to also extend around that cabinet edge and, thereby, direct a laminar-type flow of de-ionizing air downwardly across the entire outer surface of the monitor screen 26. To further control the velocity of the de-ionizing air, an adjustable baffle **16*a* is mounted within the duct 16**.

The side shields 23, 24, as positioned on the monitor cabinet 13, essentially form extensions of the forming nozzle 21 and, thereby, further confine the flow of de-ionizing air across only the monitor screen. While the shields are shown as formed with an outward, downwardly extending taper, rectangular shields of suitable width could also be employed with equal effectiveness. As illustrated, the side shields are interconnected by, and may form an integral part of, an intermediate support shield or plate 27. This not only facilitates the mounting of the shields adjacent (and optionally secured to) opposite sides of the monitor screen, but allows an arcuate portion of the forming nozzle 21 to pass through a slot **27*a*** formed in the support plate and, thereby, be supported by the latter.

Should it be desired in any particular application to defuse the downwardly directed flow of de-ionizing air upon the latter impinging against, a workbench (or desk top) 31 on which the monitor 11 is mounted, a suitable mesh screen (or porous membrane) 36 could be optionally positioned within a pre-formed slot 37 formed in the workbench, as shown in phantom in FIG. 2. Such an airflow passageway would effectively minimize any possibility of the de-ionizing air being reflected partially outwardly and upwardly to cause a noticeable draft to an operator. In practice, however, when utilizing a low velocity flow of de-ionizing air produced at room temperature, it has been found to present no discomfort to an operator while positioned in close proximity to the monitor.

With the flow of de-ionizing air being controlled and confined as described above, it has advantageously been found to completely prevent the build-up of any detrimental electrostatic charge on the outer surface of the monitor screen 26. In addition, neither the de-ionizing air generating system, nor the confined, downwardly directed flow of air produced thereby, as noted above, in any way interferes with either the comfort of an operator or the work functions performed by the latter while positioned in close proximity to the monitor.

Figure 3:
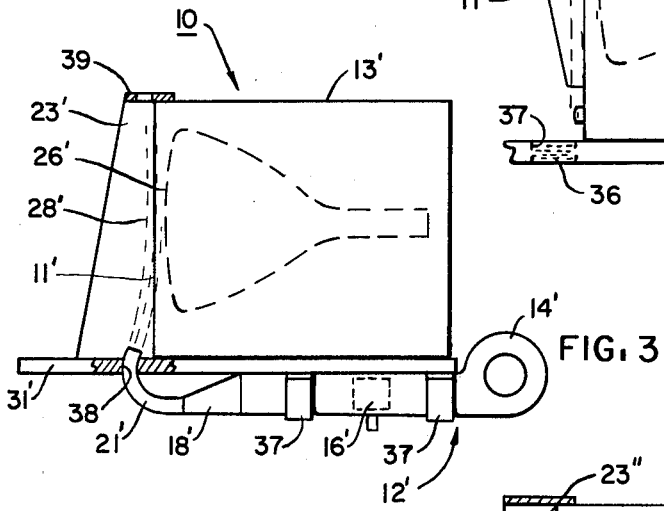
FIG. 3 is a side elevational view illustrating an embodiment of the invention similar to that of FIG. 1, but distinguishing therefrom by having the major portion of the de-ionizing air generating system mounted beneath the monitor, so as to effect a laminar-type flow of de-ionizing air across the monitor screen from the bottom to the top thereof in accordance with the principles of the present invention.

Should it be desired for any reason to direct the flow of de-ionizing air across the monitor screen from the bottom to the top, rather than vice versa, this may be readily accomplished by simply mounting the major portion of the de-ionizing air generating system beneath the monitor, and preferably beneath the workbench (or desk top) upon which the monitor is supported, as depicted in FIG. 3. With the various elements in FIG. 3 that at least substantially correspond with those in FIGS. 1 and 2 being identified by like, but primed, reference numerals, it is seen that the de-ionized air blower 14', duct 16', fan-out nozzle 18' and major portion of the forming nozzle 21' are all mounted on the underside of a workbench 31', such as by means of suitable support brackets 37.

With such an arrangement, the workbench 31' (or desk top) would require a slot 38 formed therethrough in a region along the lower forward edge of the monitor cabinet 13' so as to allow the arcuate, forward end of the forming nozzle to project upwardly therethrough. With the forming nozzle thus directed, it is seen that while the side shields 23', 24' could be identical to those in the embodiment of FIGS. 1 and 2, it would normally be preferable for the shields to be of maximum width at the base of the monitor, and taper inwardly toward the top thereof so as to more effectively confine the flow of de-ionizing air across the screen 26'.

To that end, the side shields 23', 24' are illustrated as being respectively secured along opposite edges of the monitor cabinet 13', with an optional interconnecting center leg portion 39 (shown in phantom) secured to or resting on the top edge of the monitor cabinet, and preferably slotted to allow the stream of de-ionizing air to pass therethrough. As previously noted, the shields 23', 24' could also be formed without any taper, if desired, e.g., be of rectangular cross-section, or have outer edges of any desired compound contour, such as for esthetic reasons, and still accomplish the same desired results.

It should also be appreciated that the entire de-ionizing air generating system 12' in FIG. 3 could also be mounted on the top side of the workbench 31', such that the duct 14', fan-out nozzle 16' and a portion of the arcuate forming nozzle 21' would be interposed between the base of the monitor cabinet 13' and the top surface of the workbench 31'. This arrangement would obviate the need for any forming nozzle-receiving slot in the workbench, but would require a spaced array of support brackets, or spacer blocks (not shown) to allow the positioning of the de-ionizing air generating system 12' between the CRT monitor and the workbench.

Figure 4:
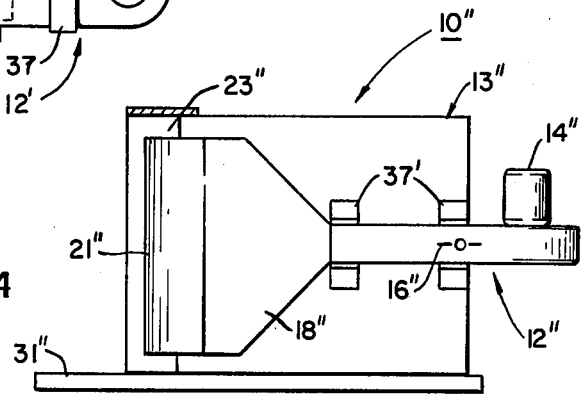
FIG. 4 is a side elevational view illustrating an embodiment of the invention also similar to that of FIG. 1, but distinguishing therefrom by having the major portion of the de-ionizing air generating system mounted on one side of the monitor cabinet, so as to effect a flow of de-ionized air laterally across the monitor screen.

FIG. 4 illustrates another alternative arrangement of the de-ionizing air generating systems of FIGS. 1 and 3, with like, but higher-primed reference numerals identifying corresponding elements. As shown, the de-ionizing air blower 14", duct 16", fan-out nozzle 18" and forming nozzle 21" are all suitably secured to one chosen sidewall of the monitor cabinet 13" so as to produce and direct a desired laminar-type stream of de-ionizing air across the monitor screen 26" from the chosen side to the opposite side thereof. In all other respects, the monitor assembly 10" of FIG. 4 functions in the same manner, and produces the same beneficial results, realized in accordance with the first two preferred embodiments depicted in FIGS. 1 and 3.

Figure 5:
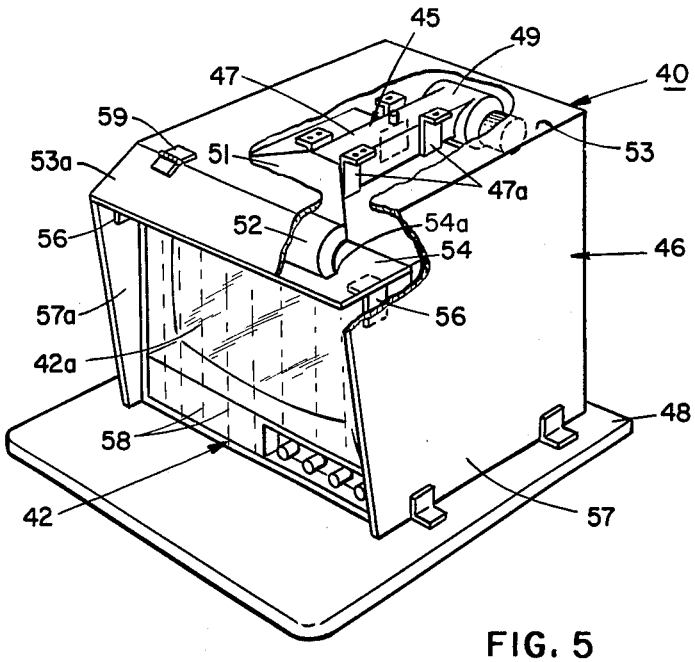
FIG. 5 is a perspective view of a CRT monitor assembly, including a common auxiliary housing for a cabinet-confined monitor, and a de-ionizing air generating system, the latter being adapted to provide and direct a confined, laminar type stream of de-ionizing air across the monitor screen in accordance with the principles of the present invention.
Figure 6:
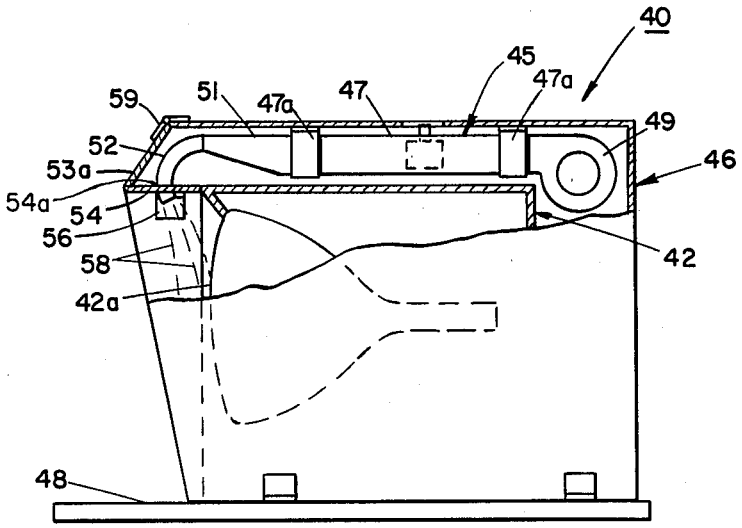
FIG. 6 is a side elevational view, partially broken away, of the CRT monitor assembly embodiment of FIG. 1, with the cathode ray tube of the monitor shown in phantom.

Attention is now directed to FIGS. 5 and 6 which illustrate a CRT monitor assembly 40, the latter distinguishing from the monitor assembly 10 of FIGS. 1 and 2 by including not only a CRT monitor 42 and a de-ionizing air generating system 45, but an auxiliary housing 46 therefor, all mounted on a suitable workbench or table 48. More specifically, the housing is adapted to confine not only the monitor 42 (with or without a cabinet) therewithin, but the de-ionizing air generating system 45, with the latter being secured to the housing in spaced relationship from the monitor cabinet, if employed, so as to in any event facilitate the removal of the monitor for repair or replacement whenever desired, or necessary.

To that end, a duct 47 is shown with brackets 47*a* attached thereto so as to facilitate the securement of not only that duct, but the interconnected blower 48, fan-out nozzle 51 and forming nozzle 52, all comprising the de-ionizing air generating system 45, to the top wall 53 of the housing 46. If desired, of course, the composite system 45 could be indirectly secured to either the top wall or sidewalls of the housing 46 through the use of any suitable cross-beams, or girders (neither shown) associated with the housing.

In order to facilitate the removal of the monitor 42 from the housing 46, it is preferable that the forming nozzle 52 be releasably coupled to the fan-out nozzle 51, and supported by a slide-out support or shield plate 54, having a laterally disposed slot 54*a* formed therethrough both to receive and support an arcuate portion of the forming nozzle. By way of illustration, the support plate 54 is shown resting at opposite ends on respectively associated brackets 56 secured to the sidewalls 57 of the housing. As thus mounted, the support plate 54 functions as a slide-out shelf so as to facilitate the removal of the CRT monitor from the housing. Such monitor removal is further facilitated by having a forward top wall portion 53*a* of the housing pivotally mounted, such as by hinges 59.

In situations where the housing 46 is dimensioned to provide close-fit confinement of a given CRT monitor therewithin, the housing sidewalls 57 can be readily formed with tapered forward portions 57*a*, as illustrated, to also function as side shields, and, thereby, facilitate the confinement of the flow of de-ionizing air 58 (shown by dash lines) across the monitor screen 42*a* from the top to the bottom thereof. Should such a close-fit relationship not always exist, or be desired, because of the housing being constructed for universal use with many different brands of monitors, for example, separate side shields of the type depicted in the first embodiment of the invention could be readily employed. Such shields, for example, could be secured to, or formed as an integral part of, the removable support plate 54, or be separately secured to the sidewalls 57 or the top wall 53 of the housing, or to the sidewalls of the monitor cabinet, in any suitable manner. In all other respects, the de-ionizing air generating system 45 functions in the same manner as the system employed in the first embodiment depicted in FIGS. 1 and 2 to produce the same beneficial end results.

In this regard, it is understood, of course, that the housing 46 could also be readily constructed to allow the de-ionizing air generating system 45 to be positioned either along one side of the confined monitor, or beneath the monitor. As such, a flow of de-ionizing air could be readily directed either laterally or upwardly across the screen 42*a*, if desired, in accordance with the principles of the invention disclosed in FIGS. 3 and 4, and described hereinabove in connection with the description of the first embodiment.

It should also be appreciated that the blower 49, as well as fan-out nozzle 51, could be independently secured to the housing 46, as is the duct 47, as illustrated. This would depend to a great extent on the strength and rigidity of the material employed to form the duct and nozzles. Similarly, it should be understood that the housing could obviously be dimensioned so as not to include the blower 49 therewithin, if desired. As for the actual configuration of the housing per se, particularly the top thereof, it is only restricted by the requirement of accommodating a given monitor and the de-ionizing air generating system, thus leaving considerable design flexibility relative to its esthetic appearance.

Figure 7:
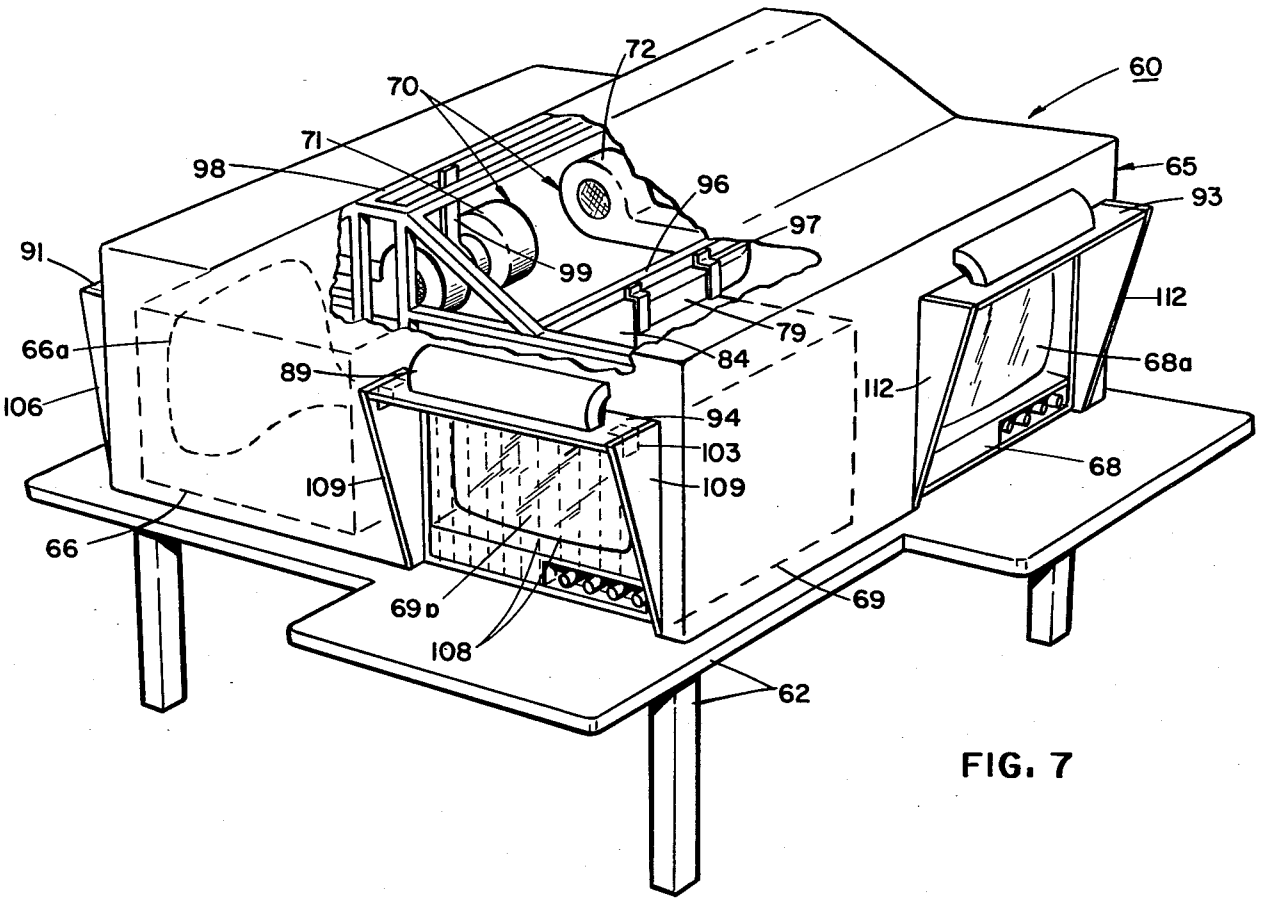
FIG. 7 is a perspective view of a CRT monitor assembly, partially broken away, illustrating the manner in which four monitors are arranged in a particular cluster within a common housing, together with a de-ionizing air generating system secured to only the housing, the generating system including two de-ionized air blowers, each one being associated with a different pair of CRT monitors to provide, through the ducting and nozzles coupled thereto, a uniformly distributed, laminar-type stream of de-ionizing air across the screens of the associated monitors in accordance with the principles of the present invention.
Figure 8:
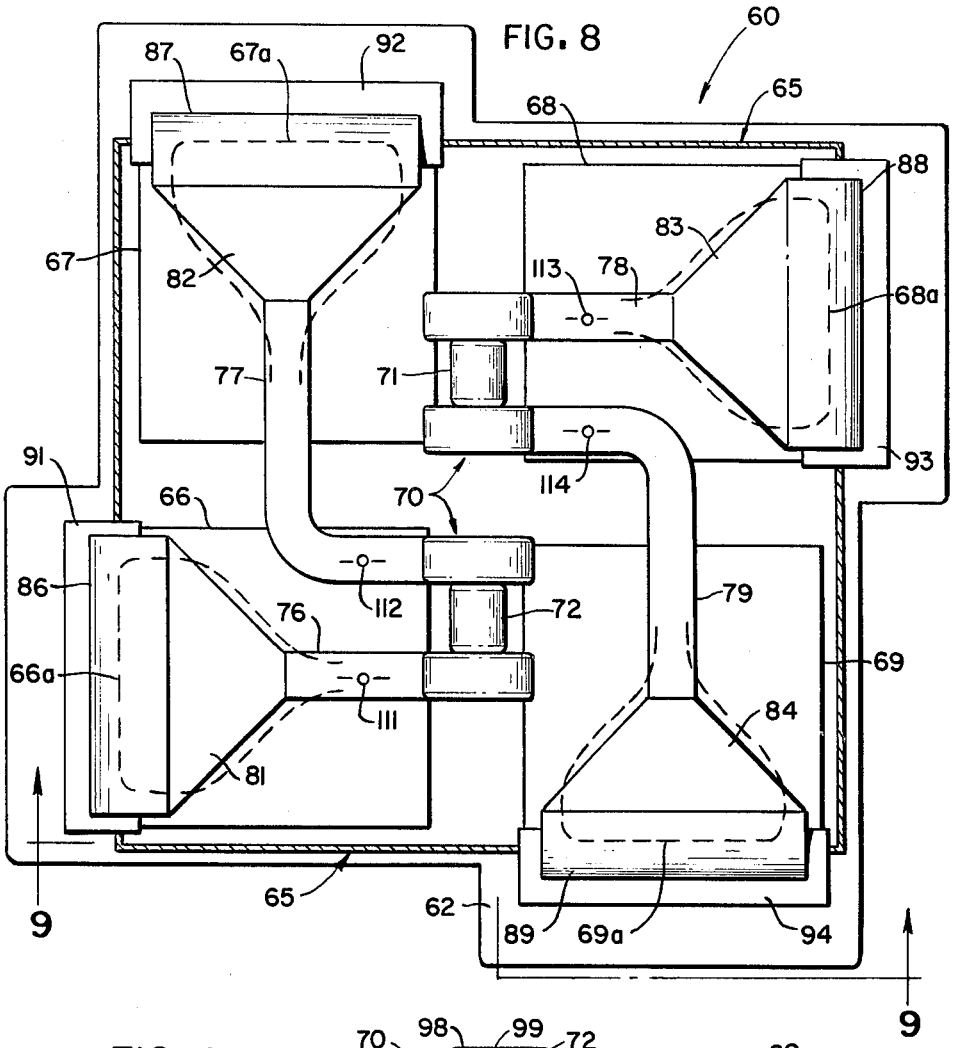
FIG. 8 is a plan view of the CRT monitor assembly of FIG. 7, showing in greater detail the manner in which the four monitors are arranged in a particular cluster within the common housing, and selectively coupled to the two de-ionizing air generating system blowers.
Figure 9:
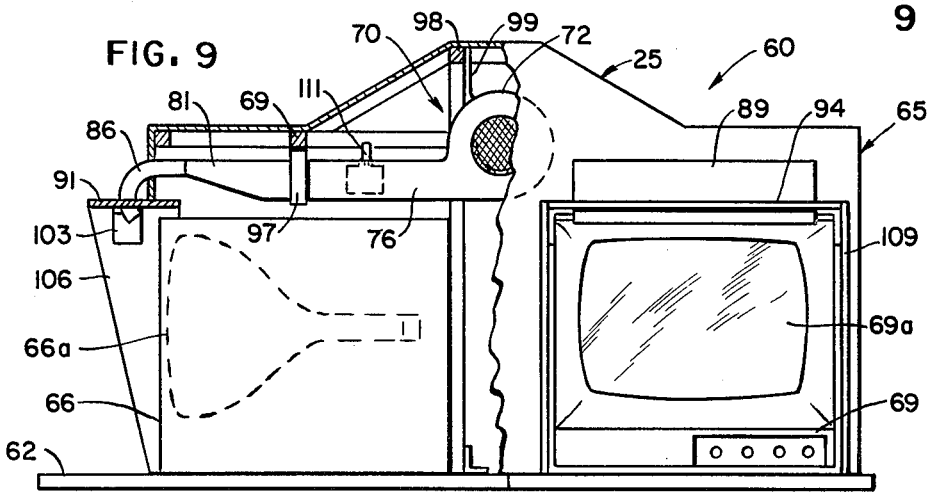
FIG. 9 is a fragmentary side elevational view, partially broken away, illustrating the ducting, and fan-out and forming nozzles associated with two of the four CRT monitors arranged in the cluster depicted in FIG. 6.

Another preferred embodiment of the invention is illustrated in FIGS. 7–9, wherein a CRT monitor assembly 60, supported on a suitable workbench or table 62, includes a special housing 65 of quadrangular configuration, the latter being adapted to confine therewithin a cluster of four CRT monitors 66–69, and a common de-ionizing air generating system 70 associated therewith. The four monitors are arranged in a unique cluster, namely, in diametrically disposed, offset pairs identified by the reference numerals 66, 68 and 67, 69. This clustered arrangement advantageously conserves costly floor space, and also facilitates the simplification of the de-ionizing air generating system 70.

Considered more specifically, the system 70 comprises two commercially available dual output port ionized air blowers 71, 72 respectively coupled to a different pair of ducts 76–77 or 78–79 which, in turn, are respectively coupled to an associated one of four fan-out nozzles 81, 82 or 83, 84. The outer flared end of each nozzle is connected to, or merges into, an associated one of four arcuate forming nozzles 86–89.

In order to facilitate the removal of any monitor from the common housing 65, the de-ionizing air generating system 70 is secured to the housing in spaced relationship relative to the monitors. This is accomplished, as best seen in FIGS. 7 and 9, by securing the respective ducts 76–79 to an associated girder 96 of the housing through the use of suitable brackets 97. The motor of each blower is shown independently secured to one of two upper girders 98, by means of a suitable clamp 99.

Also to facilitate the removal of any monitor from the common housing 65, an arcuate portion of each forming nozzle 86–89 extends through a slot formed in an associated one of four shield or support plates 91–94. In this regard, it is preferable that the plates 91–94 be freely supported at opposite ends on suitable brackets 103, seen in FIGS. 7 and 9. This allows each forming nozzle, together with the associated support plate, to be withdrawn from the common housing 65 and, thereby, completely free the associated monitor for removal from the latter.

Each of the support plates 91–94 also preferably forms an integral interconnecting leg portion between a pair of side shields 106–109 in the illustrative embodiment. It is to be understood, of course, that the side shields for each monitor, if desired, could actually comprise outwardly tapered sidewall extensions of the housing, in a manner similar to that depicted in the embodiment of FIGS. 5 and 6, or alternatively be secured to the sidewalls of the associated monitor cabinet, if employed.

With the common housing 65 and composite de-ionizing air generating system 70 constructed and assembled as described and illustrated, a distributively controlled portion of de-ionizing air 108 is fanned-out and directed in a continuous, preferably low velocity, laminar-type stream across the entire surface of each of the monitor screens **66*a*–69*a* from the top to the bottom thereof. In order to provide greater control over the velocity of the de-ionizing air streams, adjustable baffles 111–114 are respectively mounted inside the ducts 76–79. In this regard, it should be noted that while the CRT monitor assembly 60** requires the use of two de-ionized air blowers, it does have the advantage over a single blower system of providing more precise control over the volume of de-ioning air distributed to the respectively associated pairs of monitors, while also obviating the need of a common interfacing plenum or manifold.

As previously noted with respect to the first embodiment described hereinabove, the various parts of the de-ionizing air distribution system coupled to the blowers 71 and 72 may be initially manufactured as either separate or selectively chosen integral parts, as desired. Also, as described hereinabove in connection with the other preferred embodiments of the invention, the direction of flow of the de-ionizing air, if desired, may also extend from the bottom to the top, as well as from one side to the other side of the monitor screens, by simply rearranging the de-ionizing air generating system within the housing in accordance with the principles disclosed relative to the specific embodiments of FIGS. 3 and 4.

FIG. 10 illustrates a CRT monitor assembly 120 which is very similar to that of FIGS. 7–9, by including what may be an essentially identical housing 122, shown only in outer wall outline form, that is adapted to confine therewithin a cluster of four CRT monitors 126–127, and to both confine and support a common de-ionizing air generating system 130 in the same manner as in the embodiment of FIGS. 7–9. Distinguishing from the latter embodiment, however, is the fact that in the embodiment of FIG. 10 only one blower 135 is required.

Considered more specifically, the single ionized air blower 135 is coupled through a common plenum 137 to each of four ducts 141–144 which, in turn, are respectively coupled to an associated one of four fan-out nozzles 146–149. The outer flared end of each nozzle is connected to, or merges into, an associated one of four arcuate forming nozzles 151–154. These respective series of interconnected elements each results in a stream of de-ionizing air being directed across the associated screens **126*a*–129*a*** (shown by dash lines) of the four housing-confined monitors.

Optional adjustable baffles 156–159 respectively mounted in the four ducts 141–144 facilitate control over the velocity of the de-ionizing air to the monitor screens. With respect to the generation of the de-ionizing air, it should be understood that while the de-ionized air blower 135 is shown with two output ports communicating with the common plenum 137, a similar blower with only one output port could be readily employed with equal effectiveness, as long as the volume of de-ionizing air generated therewith was adequate for the particular application involved. It should be further understood that while the common plenum 137 is shown as being essentially square in cross-section, it could also be of circular or any other suitable cross section, if desired.

The embodiment of FIG. 10 also includes four slotted support plate and integral side-shield assemblies 161–164 which may be constructed and supported on the housing 122 in the same manner as described above in connection with the embodiment depicted in FIGS. 7–9. In all other respects, the various parts of the de-ionizing air generating system 130 are essentially identical to those employed in the embodiment of FIGS. 7–9, and, as previously noted, may be secured to the common housing 122, shown only in peripheral outline form, in the same basic manner described in detail hereinabove in connection with the preceding embodiment.

FIG. 11 illustrates another alternative CRT monitor assembly 170 which includes two monitors 171 and 172, positioned in back-to-back relationship on a support bench or table 173, and a de-ionizing air generating system 175 associated in common with both monitors and mounted thereon. The system 175 comprises a common de-ionized air blower 178, which may be of the type employed in any of the other embodiments, in conjunction with two ducts 181, 182, fan-out nozzles 183, 184, forming nozzles 186, 187 and slotted support plate and integral side shield assemblies 188, 189, to provide the desired stream of de-ionizing air across the monitor screens 171*a*, 172*a* (shown only positionally by dash lines).

FIG. 12 illustrates still another CRT monitor assembly 190 wherein two monitors 171', 172' are arranged in side-by-side relationship rather than in back-to-back relationship, as depicted in FIG. 11. As the various parts of the monitor assembly 190 at least substantially correspond with those in FIG. 11 in all other respects, they are all identified by like, but primed, reference numerals. The juxtaposed arrangement of the monitors in FIG. 12 has the advantage of allowing any number of such monitors to be arranged in a row, with de-ionizing air directed across the screen of each monitor through the utilization of a single de-ionized air blower, in conjunction with extended ducting or a suitable baffle-adjustable air-distributing manifold (neither shown).

When only two monitors are arranged in juxtaposed relationship, as well as back-to-back relationship, as depicted in FIGS. 11 and 12, the utilization of a two-port ionized air blower, connected to the two associated ducts in a manner illustrated in FIG. 8, is of particular advantage in further insuring the equal distribution of air to the two monitors with no specially constructed plenum, or manifold, being required as an interface between the blower and ducting.

While several related and preferred CRT monitor assemblies, and sub-assemblies, each incorporating a specially constructed de-ionizing air generating system, have been disclosed herein, it is obvious that various modifications may be made to the present illustrative embodiments of the invention, and that a number of alternative relative embodiments could be devised by one skilled in the art without departing from the spirit and scope of the invention.

What is claimed is:

1. A CRT monitor assembly comprising:

a CRT monitor which includes a display screen that normally inherently tends to build-up a relative high electrostatic charge on the surface thereof when said monitor is energized, and a de-ionizing air generating system for preventing electrostatic charge build-up on said monitor, said system including:

a. first means, comprising an electrically operated ionized air blower having at least one output port, and b. second means coupled to said first means for initially receiving, then fanning out and forming said supply of ionized air into a thin stream of de-ionizing air, with the latter being directed immediately adjacent to, and across, said screen from one predetermined edge to and beyond the opposite edge thereof, said second means including a thin, wedge-shaped fan-out nozzle portion, and a wide, thin arcuate forming nozzle portion that communicates with both the outer end of said fan-out nozzle portion and the predetermined edge of said monitor screen, said forming nozzle portion being contoured so as to re-direct said stream of de-ionizing air at a relatively sharp angle from a first trajectory after passing through said fan-out nozzle portion to a second trajectory substantially parallel as well as adjacent to the surface of said monitor screen, the proximity of said stream of de-ionizing air to said screen preventing the build-up of detrimental electrostatic charge on the surface of the latter.

2. A CRT monitor assembly in accordance with claim 1 wherein said monitor includes a cabinet, wherein said de-ionized air generating system is mounted at least in part on an outer wall portion of said cabinet, and wherein said second means further includes a pair of side sheilds, said shields being positioned and supported on said cabinet so as to define side bounaries for said stream of de-ionized air in passing across said monitor screen.

3. A CRT monitor assembly in accordance with claim 1 further comprising an auxiliary housing within which said monitor is confined, but with the screen thereof exposed, together with said de-ionized air generating system, with the latter being secured only to said housing, and wherein said assembly further includes a pair of side shields and an interconnecting shield plate, all selectively mounted on said monitor and housing, said side shields being positioned relative to said monitor screen so as to define side boundaries for said stream of de-ionized air directed thereacross, and said shield plate being positioned along said predetermined monitor screen edge, and having an elongated, laterally disposed slot formed therethrough to receive a section of the forming nozzle portion of said second means.

4. A CRT monitor assembly in accordance with claim 3 wherein said stream of de-ionized air is directed downwardly across said monitor screen from said predetermined edge, which comprises the top edge, to the bottom edge thereof, and wherein each of said side shields comprises a forward, outwardly extending portion of a different one of said housing sidewalls.

5. A CRT monitor assembly in accordance with claim 2 wherein said stream of de-ionized air is directed across the outer surface of said monitor screen from said predetermined edge, which comprises the top edge, to the bottom edge thereof.

6. A CRT monitor assembly in accordance with claim 3 wherein said stream of de-ionized air is directed across the outer surface of said monitor screen from said predetermined edge, which comprises the top edge, to the bottom edge thereof.

7. A CRT monitor assembly in accordance with claim 2 wherein said stream of de-ionized air is directed across the outer surface of said monitor screen from said predetermined edge, which comprises the bottom edge, to the top edge thereof.

8. A CRT monitor assembly in accordance with claim 2 wherein said stream of de-ionized air is directed across the outer surface of said monitor screen from said predetermined edge, which comprises one side edge, to the opposite side edge thereof.

9. A CRT monitor assembly in accordance with claim 3 wherein said stream of de-ionized air is directed across the outer surface of said monitor screen from said predetermined edge, which comprises one side edge, to the opposite side edge thereof.

10. A CRT monitor assembly in accordance with claim 3 wherein said stream of de-ionized air is directed across the outer surface of said monitor screen from said predetermined edge, which comprises the bottom edge, to the top edge thereof.

11. A CRT monitor assembly in accordance with claim 6 further including a workbench for directly supporting said monitor and indirectly supporting said de-ionized air generating system, said workbench including a slot that extends therethrough, said slot being positioned and dimensioned to allow said stream of de-ionized air, after being directed downwardly across said monitor screen, to at least substantially pass therethrough.

12. A CRT monitor assembly in accordance with claim 8 further including a workbench for supporting said monitor on the top side and at least said second means for forming a stream of de-ionized air on the underside thereof, with said workbench including a slot that extends therethrough, said slot being positioned and dimensioned to allow at least a section of said forming nozzle portion to extend therethrough and communicate with said monitor screen.

13. A CRT monitor assembly comprising:

at least two CRT monitors positioned in close proximity to each other, with each including a display screen that normally inherently tends to build-up a relatively high electrostatic charge on the surface thereof when said monitor is energized, and a de-ionizing air generating system for preventing electrostatic charge build-up on said monitor, said system including:

a. first means for generating a supply of ionized air, with said first means being common to said two monitors, and;

b. separate second means coupled between said first means and each of said monitors for initially receiving, then fanning out and forming said supply of ionized air into a thin stream of de-ionizing air, with the latter being directed immediately adjacent to, and across, said screen from one predetermined edge to and beyond the opposite edge thereof, the proximity of said stream of de-ionizing air to said screen preventing the build-up of detrimental electrostatic charge on the surface of the latter.

14. A CRT monitor assembly in accordance with claim 13 wherein said first means comprises an electrically operated de-ionizing air blower, and wherein each of said second means includes a thin, wedge-shaped fan-out nozzle portion, and a wide, thin, arcuate forming nozzle portion that communicates with both the outer end of said fan-out nozzle portion and the predetermined edge of said associated monitor screen.

15. A CRT monitor assembly in accordance with claim 14 wherein each of said monitors includes a cabinet, and wherein said de-ionized air generating system is mounted at least in part on outer wall portions of said cabinets, and wherein each of said second means associated with a different monitor further includes a pair of side shields, said shields being positioned on either side of said associated monitor cabinet, and support thereby, so as to define side boundaries for said stream of de-ionized air in passing across the associated monitor screen.

16. A CRT monitor assembly in accordance with claim 15 wherein said monitors are confined within a common auxiliary housing, but with the screens thereof exposed, together with said de-ionized air generating system, with the latter being secured only to said housing so as to facilitate the removal of any monitor from said housing.

17. A CRT monitor assembly in accordance with claim 16 wherein said de-ionized air generating system further includes a common plenum directly coupled to said de-ionizing air blower, wherein a plurality of CRT monitors are arranged in a predetermined cluster within said common housing, and wherein separate second means is coupled between said common plenum and an associated one of said monitors.

18. A CRT monitor assembly in accordance with claim 17 wherein four CRT monitors are arranged in a predetermined cluster comprised of two pairs within said common housing, with each pair of said monitors having a separate de-ionized air generating system associated in common therewith.

19. A CRT monitor assembly in accordance with claim 18 wherein said monitors are arranged in diametrically disposed, offset pairs within said housing, and wherein said CRT monitor assembly further includes a different pair of side shields associated with each of said monitors, each pair of side shields being positioned relative to said associated monitor screen, and selectively supported on said housing and associated monitor, so as to define side boundaries for said stream of de-ionized air in passing across said screen.

20. A CRT monitor assembly in accordance with claim 19 further including a shield plate which interconnects each pair of side shields, said shield plate having an elongated, laterally disposed slot formed therethrough to receive a section of the forming nozzle portion of said associated second means in a manner that allows said forming nozzle portion to be readily removed from said fan-out nozzle portion to facilitate the removal of the associated monitor from said housing.

21. A CRT monitor assembly comprising:

at least two CRT monitors, each of which includes a display screen that normally inherently tends to build-up a relatively high electrostatic charge on the surface thereof when energized, and a de-ionized air generating system, said system including:

a. de-ionizing air blower means common to at least said two monitors for generating a supply of de-ionized air, and b. at least two de-ionized air distributing means coupled to said common air blower means, each of said distributing means being adapted to initially receive, and thereafter form a divided portion of the supply of said de-ionized air into a thin, laminar-type stream thereof, with the latter being directed immediately adjacent to and across the associated one of said monitor screens from one predetermined edge to and beyond the opposite edge thereof, the proximity of each stream of de-ionized air to the associated one of said monitor screens preventing the build-up of detrimental electrostatic charge on the surface of the latter, each of said second means including a predetermined length of ducting coupled to said de-ionizing air blower means, a thin, wedge-shaped fan-out nozzle portion coupled to said ducting, and a wide, thin, arcuate forming nozzle portion that communicates with both the outer end of said fan-out nozzle portion and the predetermined edge of said associated monitor screen.

22. A CRT monitor assembly in accordance with claim 21 wherein each of said monitors includes a cabinet, wherein said de-ionized air generating system is mounted at least in part on outer wall portions of said cabinets, and wherein each of said distributing means associated with a different monitor further includes a pair of side shields, said shields being positioned on opposite sides of said monitor cabinet, and supported thereby, so as to define side boundaries for said stream of de-ionized air in passing across the associated monitor screen.

23. A CRT monitor assembly in accordance with claim 22 wherein at least said two monitors are confined within a common auxiliary housing, but with the screens thereof exposed, together with said de-ionized air generating system, with the latter being secured only to said housing so as to facilitate the removal of any monitor from said housing, and wherein said CRT monitor assembly further includes a different pair of side shields associated with each of said monitors, each pair of side shields being positioned relative to said associated monitor screen, and selectively supported on said housing and associated monitor, so as to define side boundaries for said stream of de-ionized air in passing across said screen.

24. A CRT monitor assembly in accordance with claim 23 wherein a plurality of CRT monitors are arranged in a predetermined cluster within said common housing, wherein said de-ionizing air blower means is common to all of said monitors, and further includes a common interfacing plenum, and wherein each of said separate distributing means is coupled between said common plenum and an associated one of said monitors.

25. A CRT monitor assembly in accordance with claim 24 wherein four CRT monitors are arranged in a predetermined cluster comprised of two pairs within said common housing, with each pair of said monitors having a separate de-ionized air generating system associated in in common therewith, and wherein said assembly further includes separate support members respectively interposed between said pairs of side shields, each member being selectively mounted on said housing, side shields and associated monitor, and positioned along said predetermined edge of the associated monitor screen, with said member having an elongated, laterally disposed slot formed therethrough to receive a section of the forming nozzle of said associated distributing means.

26. A CRT monitor assembly in accordance with claim 25 wherein said four monitors are arranged in diametrically disposed, offset pairs within said housing which has a quadrangular cross-section.

27. A CRT monitor assembly in accordance with claim 24 wherein a plurality of CRT monitors in multiples of two are arranged in a predetermined cluster and subdivided in pairs within said common housing, with each pair of monitors having a separate de-ionized air generating system associated in common therewith, and with each of said latter systems being secured only to said common housing so as to facilitate the removal of any monitor from the latter.

28. A CRT monitor assembly in accordance with claim 24 further including separate support plates respectively interposed between each pair of said side shields, each support plate being releasably mounted on said housing, positioned along said predetermined edge of the associated monitor screen, and having an elongated, laterally disposed slot formed therethrough to receive a section of the forming nozzle portion of said associated distributing means.

29. A housing assembly adapted for use in confining at least one CRT monitor therewithin, and for preventing the build-up of detrimental electrostatic charge on the outer surface of the monitor screen when energized, said housing assembly comprising:

a housing having an opening in at least one sidewall thereof, said opening being dimensioned to allow a CRT monitor to be confined within said housing such that the screen of said monitor is fully exposed, and positioned substantially along the same plane as the associated sidewall of said housing, and a de-ionized air generating system confined within said housing and secured thereto, said system including:

a. first means for generating a supply of de-ionized air, and b. second means coupled to said first means for initially receiving, then fanning out and forming said supply of de-ionized air into a thin stream thereof, with the latter being directed immediately adjacent to and across the screen of a monitor when confined within said housing, said stream extending from one predetermined edge to and beyond the opposite edge of such a monitor screen, the proximity of said stream of de-ionized air to such a screen preventing the build-up of detrimental electrostatic charge on the surface of the latter.

30. A housing assembly in accordance with claim 29 wherein said first means comprises a de-ionizing air blower, wherein said second means includes a predetermined length of ducting coupled to said de-ionizing blower, a thin, wedge-shaped fan-out nozzle portion coupled to said ducting, and a wide, thin, arcuate forming nozzle portion that communicates with both the outer end of said fan-out nozzle portion and the predetermined edge of the screen of an associated monitor when confined within said housing, and wherein said assembly further includes a pair of side shields, said shields being positioned relative to an associated screen of such a confined monitor, and selectively mounted on the latter and said housing, so as to define side boundaries for said stream of de-ionized air in passing across the screen of such a confined monitor, and wherein said assembly also includes a support member interposed between said pair of side shields, said member being positioned along said predetermined edge of the screen of a confined monitor, and selectively mounted on the latter, said side shields and said housing, said member further having an elongated, laterally disposed slot formed therethrough to receive a section of said forming nozzle portion of said second means.

31. A housing assembly in accordance with claim 30 wherein said housing is adapted with at least one additional sidewall opening to receive a second CRT monitor therewithin, wherein said first means for generating a supply of de-ionized air is common to at least two monitors when confined within said housing, and wherein separate second means is coupled between said first means and a a different one of such confined monitors, each of said second means including a thin, wedge-shaped fan-out nozzle portion, and a wide, thin, arcuate forming nozzle portion that communicates with both the outer end of said fan-out nozzle portion and a predetermined edge of the screen of an associated one of such confined monitors.

32. A housing assembly in accordance with claim 31 wherein said first means for generating a supply of de-ionized air comprises a de-ionizing air blower coupled to each of said second means, and wherein each of the latter further includes a separate pair of side shields, each pair being positioned relative to an associated monitor when confined within said housing, and selectively mounted on such an associated monitor and housing, so as to define side boundaries for said stream of de-ionized air in passing across such an associated monitor screen.

33. A housing assembly in accordance with claim 30 wherein said housing has a plurality of sidewall openings respectively adapted to allow separate ones of a plurality of CRT monitors to be confined in a cluster within said housing, and wherein said first means for generating said supply of de-ionized air is common to all of said second means respectively associated with such confined monitors.

34. A housing assembly in accordance with claim 33 wherein said housing has a plurality of sidewall openings respectively adapted to confine separate ones of a plurality of CRT monitors arranged in predetermined pairs therewithin, with each pair of such confined monitors having separate de-ionized air generating systems respectively associated therewith, and wherein said assembly further includes separate support members respectively interposed between said pairs of side shields, each member being selectively mounted on said housing, side shields and an associated monitor when confined therewithin, and positioned along said predetermined edge of the screen of such associated monitor, with each of said members further having an elongated, laterally disposed slot formed therethrough to receive a section of said forming nozzle portion of the associated second means.

35. A housing assembly in accordance with claim 34 wherein said housing has four sidewalls, each having a separate CRT monitor-receiving opening formed therein, with the openings being positioned so as to allow four monitors to be arranged in diametrically disposed, offset pairs within said housing.

36. A housing assembly in accordance with claim 34 wherein said first means for generating a supply of de-ionized air comprises a de-ionizing air blower coupled to each of said second means, and wherein each of the latter means includes a predetermined length of ducting coupled to said de-ionizing air blower, a thin, wedge-shaped fan-out nozzle portion coupled to said ducting, and a wide, thin, arcuate forming nozzle portion that communicates with both the outer end of said fan-out nozzle portion and a predetermined edge of the screen of an associated monitor when positioned within said housing, each of said second means further including a pair of side shields, said shields being positioned relative to an associated screen of such a confined monitor, and selectively supported by the latter and said housing, so as to define side boundaries for said stream of de-ionized air in passing across the screen of an associated one of such confined monitors.

37. A housing assembly in accordance with claim 36 further including separate shielding members respectively interposed between said pairs of side shields, each member being selectively supported by said housing, side shields and an associated monitor when confined therewithin, and positioned along said predetermined edge of the screen of an associated one of such confined monitors, with each of said members further having an elongated, laterally disposed slot formed therethrough to receive a section of said forming nozzle portion of the associated second means.

38. A de-ionizing air generating assembly particularly adapted for use with, and to provide and direct a laminar-type stream of de-ionizing air in a predetermined direction across the screen of, a CRT display monitor, when energized, so as to prevent the build-up of detrimental electrostatic charge on the screen, said assembly being adapted for mounting selectively on such an associated monitor and on any auxiliary structure when employed with the latter, and comprising:

first means, comprising an electrically operated ionized air blower having at least one output port, for generating a supply of ionized air, and second means coupled to said first means for initially receiving, then fanning out and forming said supply of ionized air into a thin stream of de-ionizing air, with the latter being directed immediately adjacent to, and across, a screen of an associated monitor from one predetermined edge to and beyond the opposite edge of such a screen, said second means including a thin, wedge-shaped fan-out nozzle portion coupled at the narrow end thereof to said output port, and a wide, thin, arcuate forming nozzle portion that communicates with both the wide end of said fan-out nozzle portion and the predetermined edge of an associated monitor screen, said forming nozzle portion being contoured so as to re-direct said stream of de-ionizing air at a relatively sharp angle from a first trajectory after passing through said fan-out nozzle portion to a second trajectory substantially parallel and adjacent to the surface of an associated monitor screen, with the proximity of said stream of de-ionizing air to the screen preventing the build-up of detrimental electrostatic charge on the surface of the latter.

39. A de-ionized air generating assembly in accordance with claim 38 wherein said assembly is particularly adapted to be mounted selectively on a monitor cabinet and an auxiliary housing for confining a monitor, and wherein said second means further includes a pair of side shields, said shields being positioned relative to an associated monitor screen, and selectively supported on an associated monitor and auxiliary housing therefor, so as to define side boundaries for said stream of de-ionized air in passing across an associated monitor screen.

40. A de-ionized air generating assembly in accordance with claim 39 wherein a shielding member interconnects said pair of side shields, said member having an elongated, laterally disposed slot formed therethrough to receive and support a section of the forming nozzle portion of said second means.

41. A de-ionized air generating assembly in accordance with claim 40 wherein there are at least two second means coupled to said de-ionizing air blower such that the screens of at least two CRT monitors, when employed with said assembly, are each supplied with a distributed equal portion of the supply of de-ionized air.

42. A de-ionized air generating assembly in accordance with claim 40 further including a common plenum, and wherein there are a plurality of second means coupled to said de-ionizing air blower through said interfacing plenum in common therewith, each assembly thus allowing a plurality of CRT monitors, when employed therewith, and corresponding in number to said second means, being arranged in a predetermined cluster, with the screen of each monitor being supplied with a distributed equal portion of the supply of de-ionized air.

43. A de-ionized air generating assembly in accordance with claim 42 wherein there are at least two second means coupled to said de-ionizing air blower such that the screens of at least two CRT monitors, when employed with said assembly, are each supplied with a distributed equal portion of the supply of de-ionized air.

* * * * *

UNITED STATES PATENT AND TRADEMARK OFFICE

CERTIFICATE OF CORRECTION

PATENT NO. : 4,370,695

DATED : January 25, 1983

INVENTOR(S) : L. C. Penick

It is certified that error appears in the above-identified patent and that said Letters Patent are hereby corrected as shown below:

In the specification and the claims, "de-ionized" should read --de-ionizing-- in the following places:

| Column | Line | Column | Line | Column | Line | Column | Line | Column | Line |
|---|---|---|---|---|---|---|---|---|---|
| 10 | 18 | 11 | 2 | 12 | 22 | 13 | 20 | 16 | 43 |
| 10 | 24 | 11 | 7 | 12 | 33 | 13 | 29 | 16 | 52 |
| 10 | 29 | 11 | 14 | 12 | 48 | 13 | 43 | 16 | 54 |
| 10 | 36 | 11 | 17 | 12 | 52 | 13 | 62 | 16 | 60 |
| 10 | 50 | 11 | 23 | 12 | 53 | 14 | 19 | 16 | 67 |
| 10 | 55 | 11 | 63 | 12 | 63 | 15 | 15 | 18 | 3 |
| 10 | 60 | 12 | 6 | 13 | 8 | 15 | 30 | | |
| 10 | 65 | 12 | 11 | 13 | 15 | 15 | 63 | | |

"de-ionizing" should read --de-ionized-- in the following places:

| Column | Line | Column | Line | Column | Line | Column | Line |
|---|---|---|---|---|---|---|---|
| 11 | 55 | 12 | 68 | 15 | 53 | 18 | 5 |
| 12 | 50 | 13 | 34 | 17 | 3 | | |

Column 6, line 9, "48" should read --49--.
Column 8, line 6, "de-ioning" should read --de-ionizing--.
Column 10, claim 2, line 22, "sheilds, said" should read --shields, said--.
Column 12, claim 15, line 2, "ized" should read --izing--.
Column 12, claim 21, line 51, "supply of" should read --stream of--.
Column 12, claim 21, line 57, "de-ionized" should read --ionized--.
Column 12, claim 21, line 58, "thereof" should read --of de-ionizing air--.
Column 14, claim 29, line 22, "de-ionized" should read --ionized--.
Column 14, claim 29, line 26, "de-ionized" should read --ionized--.

UNITED STATES PATENT AND TRADEMARK OFFICE

CERTIFICATE OF CORRECTION

PATENT NO. : 4,370,695

DATED : January 25, 1983

INVENTOR(S) : L. C. Penick

It is certified that error appears in the above—identified patent and that said Letters Patent is hereby corrected as shown below:

Column 14, claim 29, line 27, "thereof" should read --of de-ionizing air--.
Column 14, claim 29, line 33, "ionized" should read --ionizing--.
Column 14, claim 30, line 37, "a de-ionizing" should read --an ionized--.
Column 14, claim 30, line 39, "de-ionizing" should read --ionized--.
Column 14, claim 30, line 50, "de-ionized" should read --ionizing--.
Column 14, claim 31, line 64, "de-ionized" should read --ionized--.
Column 15, claim 32, line 7, "of de-" should read --of--.
Column 15, claim 32, line 8, "a de-ionizing" should read --an ionized--.
Column 15, claim 33, line 22, "de-ionized" should read --ionized--.
Column 15, claim 36, line 49, "of de-" should read --of--.
Column 15, claim 36, line 50, "a de-ionizing" should read --an ionized--.

UNITED STATES PATENT AND TRADEMARK OFFICE

CERTIFICATE OF CORRECTION

PATENT NO. : 4,370,695 PAGE 3 OF 3

DATED : January 25, 1983

INVENTOR(S) : L. C. Penick

It is certified that error appears in the above—identified patent and that said Letters Patent is hereby corrected as shown below:

Column 16, claim 41, line 62, "de-ionizing" should read --ionized--.
Column 16, claim 41, line 65, "the supply of de-ion" should read --said de-ionizing--.
Column 16, claim 41, line 66, "ized air" should read --air--.
Column 18, claim 42, line 1, "supply of de-ion" should read --said de-ionizing--.
Column 18, claim 42, line 2, "ized air" should read --air--.
Column 18, claim 43, line 8, "supply of de-ion" should read --said de-ionizing--.
Column 18, claim 43, line 9, "ized air" should read --air--.

Signed and Sealed this

*Twenty-sixth* Day of *July 1983*.

[SEAL]

*Attest:*

GERALD J. MOSSINGHOFF

*Attesting Officer* *Commissioner of Patents and Trademarks*